United States Patent [19]

Frank et al.

[11] Patent Number: 4,854,082

[45] Date of Patent: Aug. 8, 1989

[54] APPARATUS FOR GRINDING TOOTH REPLACEMENT PRIMARY CROWN CASTINGS

[75] Inventors: Christian Frank; Helmut Knosp, both of Pforzheim, Fed. Rep. of Germany

[73] Assignee: C. Hafner, Pforzheim, Fed. Rep. of Germany

[21] Appl. No.: 164,109

[22] Filed: Mar. 4, 1988

[30] Foreign Application Priority Data

Mar. 6, 1987 [DE] Fed. Rep. of Germany ... 8703394[U]
Sep. 22, 1987 [DE] Fed. Rep. of Germany ... 8712740[U]

[51] Int. Cl.[4] ..... B24B 7/02; B24B 55/06; B24B 55/12

[52] U.S. Cl. ..... 51/109 R; 51/273; 51/124 R

[58] Field of Search ..... 51/109 R, 124 R, 54, 51/55 R, 71, 103 R, 121, 123 R, 273, 216 A, 216 T, 217 T, 217 A, 234, 236, 237 R; 433/156, 51, 60, 61, 62, 63, 125, 52, 57, 91

[56] References Cited

U.S. PATENT DOCUMENTS 2,413,436 12/1946 Dawson ..... 51/234
2,618,916 11/1952 Oftedal ..... 51/273
2,768,485 4/1953 Clarke ..... 51/124 R
4,292,699 10/1981 Szabo ..... 51/124 R
4,736,545 4/1988 Moss ..... 51/273

*Primary Examiner*—Frederick R. Schmidt
*Assistant Examiner*—Jack W. Lavinder

[57] ABSTRACT

An apparatus for the grinding or polishing of cylindrical (telescopic) or conical primary crown castings, which as tooth replacements are to be mounted in appropriate anchoring members and which have pins extending from their top sides in axial alignment with the centerlines of the castings, includes a base having a support column extending upwardly therefrom and supporting an electric motor having a shaft with a grinding or polishing disc mounted thereon and a crown casting receptacle is rotatably so supported on the base that its angle relative to the base is adjustably lockable and, locked at a given angle, it is movable toward the grinding disc for engagement of the casting with the grinding disc so as to be abraded at a desired angle the motor and grinding disc being surrounded by a shroud forming an air flow space in communication with the interior of the support column which also has a suction nozzle adapted to be connected to a suction line for the removal of grinding and polishing dust through the air flow space.

12 Claims, 4 Drawing Sheets

APPARATUS FOR GRINDING TOOTH REPLACEMENT PRIMARY CROWN CASTINGS

BACKGROUND OF THE INVENTION

The invention relates to apparatus for grinding cylindrical or conical primary crown castings used in the replacement of teeth which are provided with retaining pins resulting from the casting channels and extending from the top side of the castings in axial alignment with the centerlines of the castings. Primary crown castings used in the replacement of teeth and adapted to be mounted on appropriate anchoring members need to be ground, after casting, in such a manner that their side surfaces are parallel to their axis (in 0° position) for telescopic or cylindrical crowns and for conical crowns in such a manner that they extend at an angle of between 0° and 12° with respect to the axis. In order to facilitate the grinding of such crown castings it has been necessary to provide a handling arrangement which not only made the handling of the crown castings possible but which also required identification of the 0° position, that is, the axis or centerline of the casting. In accordance with a newer method the casting liquid supply channel was so arranged as to coincide with the crown centerline or axis so that the expensive and timeconsuming determination of the axis of the casting body was no longer necessary. The pin formed by the material supply channel for the casting could be used this way as a support or retaining member. The side walls of the casting are then worked utilizing the casting material pin as a reference point for grinding the side surfaces either parallel to the centerline (0° ) or at a predetermined angle relative to the centerline.

SUMMARY OF THE INVENTION

The invention provides for an apparatus with which such castings can be ground accurately and very economically.

The apparatus includes a base having a support column extending upwardly therefrom and supporting an electric motor having the shaft extending parallel to the base and provided with a grinding or polishing disc. A crown casting receptacle is rotatably so supported on the base that its angle relative to the base is adjustably lockable and that, locked at a given angle, it is movable toward the grinding disc for grinding or polishing treatment of the casting from all sides at the desired angle.

Preferably the receptacle is supported by a top plate which is hinged to a base plate which is slidably supported on the base. The receptacle is therefore angularly adjustable relative to the base or the grinding disc so that the grinding operation can be performed at a given angle and the receptacle is also rotatably mounted so that a casting mounted in the receptacle can be ground or polished all around at the given angle.

For grinding with the apparatus according to the invention the rough casting is supported by inserting the mounting pin into the receptacle which is then moved with the adjustment table toward the grinding disc which is arranged in the appropriate height so that, while the receptacle is rotated, the casting is ground or polished all around, that is, on all sides. Depending on the position of the support leg and the pivotal support plates, parallel grinding is achieved or the side surfaces may be ground at a predetermined angle by tilting the support plate with respect to the base plate such that the face of the grinding disc is arranged at the appropriate angle with respect to the casting centerline (0° position for a cylindrical shape).

With the embodiment which includes a solid base plate, on the other hand the casting may be ground to the usual angle of 6° or at any other angle by providing the receptacle with a tilt joint which permits pivoting of the receptacle by 6° off its center position so that grinding of the castings to a cone angle of between 0° and 12° is possible.

The arrangement permits not only grinding of the primary crown casting without errors within a relatively short time but also permits good control of the wall thickness of the casting during the grinding process, since the interior of the casting remains accessible during the grinding process in contrast to earlier procedures—so that the wall thickness can be measured during grinding, that is, without the need for removing the casting. This not only reduces work time but also substantially reduces the number of rejects, which was quite high with prior art procedures.

Sandpaper of various coarseness may be mounted on the face of the radial grinding disc so that a rapid preliminary abrading step may be performed with a relatively coarse paper and also a rapid intermediate abrading step with a sandpaper of medium coarseness. The final abrading step is performed using a fine grain sandpaper.

Additionally a polishing cloth may be disposed on the grinding disc in order to achieve a high-gloss finish on the surfaces of the crown body. It is advantageous if the speed of the electric motor can be adjusted to the various abrading and polishing steps, that is, if the apparatus according to the invention includes a motor speed controller.

The receptacle is preferably a normal drill chuck which, mounted slidably on the base, can be easily moved back and forth especially if the drill chuck is mounted on a grasping column. The sliding movement may be under the control of a guide structure arranged in such a manner that the workpiece to be ground is always correctly brought into contact with the grinding disc. It is also possible to mount the receptacle on a pivot arm and move the workpiece into contact with the grinding disc by means of the pivot arm.

It is further advantageous if the electric motor and the grinding disc are closely surrounded by a shroud in such a manner that an annular unobstructed space remains through which grinding dust can be sucked away. For this reason the support column is preferably hollow and is provided near the base with an outwardly projecting suction nozzle by which the apparatus may be connected to a suction hose. Grinding dust is then securely removed by way of the hollow support column through the annular air flow space between the electric motor and the grinding disc on one side and the surrounding shroud on the other. At the same time cooling is provided for the electric motor.

As a result the apparatus according to the invention does not only provide for accurate grinding of primary crown castings but it insures that such grinding is performed efficiently and practically without any rejects.

SHORT DESCRIPTION OF THE DRAWINGS

Figure 4:
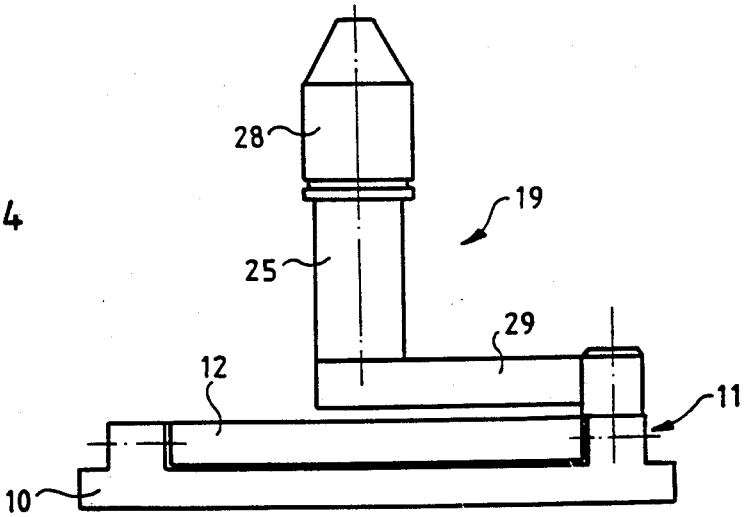
Figure 5:
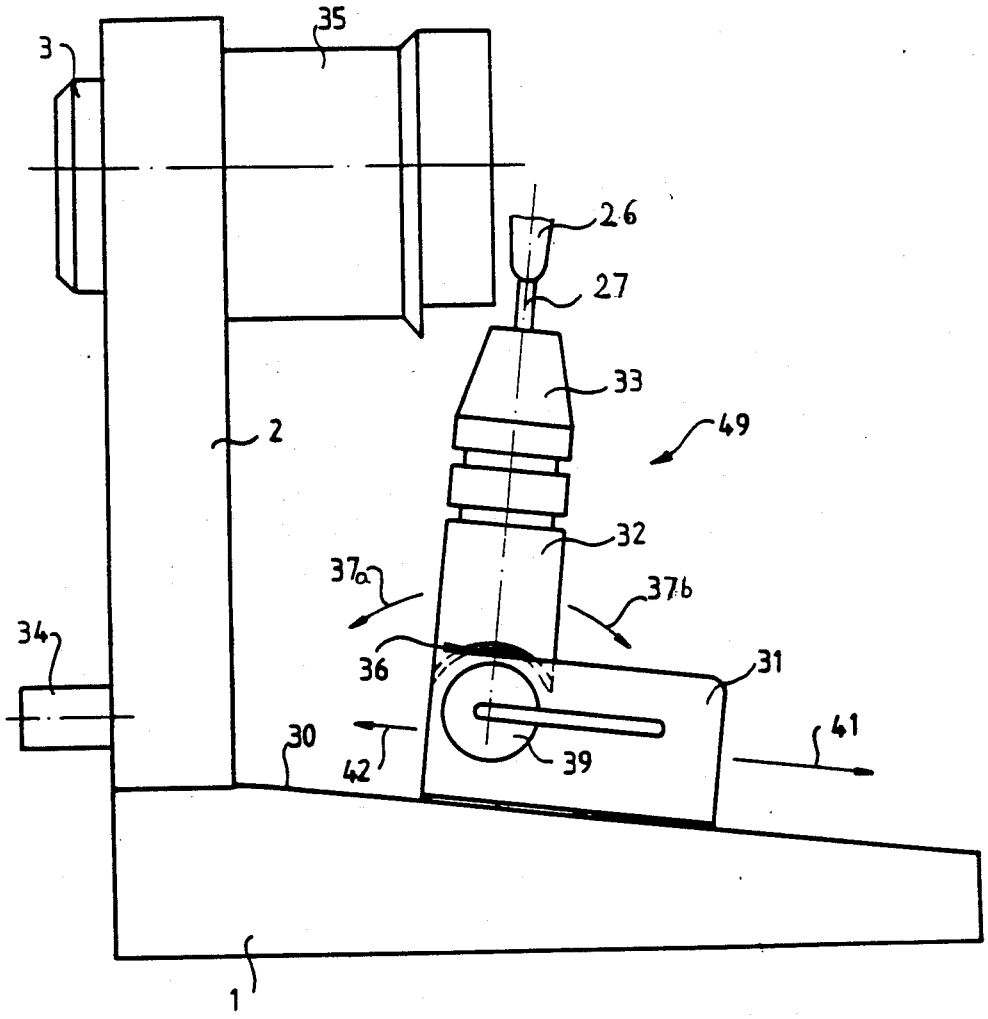
Figure 6:
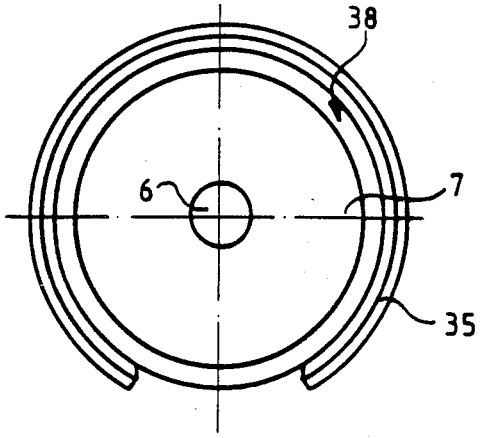
Figure 7:
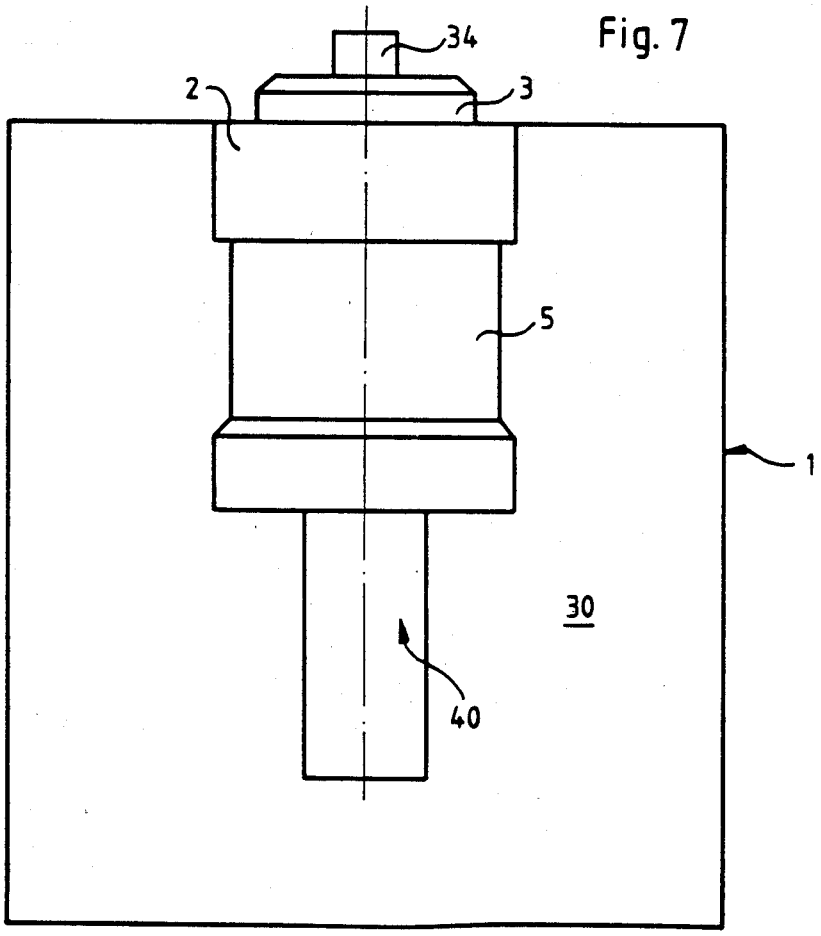

FIG. 4 is a side view of a support base with pivot arm;
FIG. 5 is a side view of an alternative arrangement;
FIG. 6 is a front view of the grinding disc; and
FIG. 7 is a top view of the apparatus.

DESCRIPTION OF THE PREFERRED EMBODIMENTS

Figure 1:
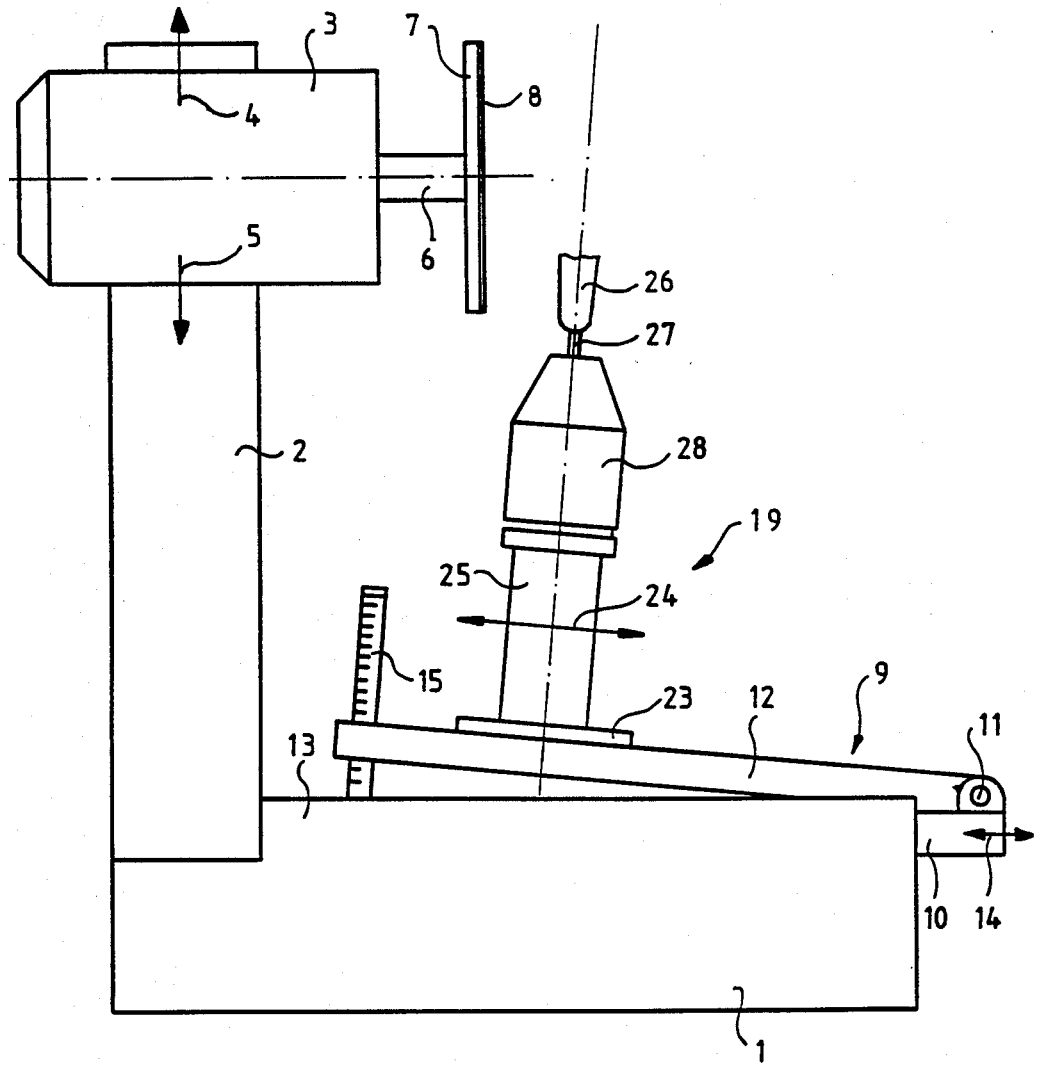
FIG. 1 is a side view of the apparatus according to the invention.

As shown in FIG. 1 a base 1 has supported thereon a support column 2 on which an electric motor 3 is height-adjustably supported as indicated by arrows 4 and 5 in such a manner that the motor shaft 6 extends parallel to the base 1. At its free end the shaft 6 carries a radial grinding disc 7 onto which grinding paper or polishing sheets 8 may be cemented.

Disposed on the base 1 is an adjusting table 9 which consists of a base plate 10 and a top plate 12 connected to the base plate 10 by a hinge 11. The adjustable table 9 is slidably supported on the base 1 by way of guide rails 13 which are arranged on the side of the base 1 so that the table 9 is movable toward or from the grinding discs 7 as indicated by double arrow 14. The adjustable table 9 can be locked to the base 1 by means of locking screws or a magnetic locking plate. The base plate 10 has a scale rod 15 pivotally supported thereon such that the scale rod 15 extends through an opening in the top plate 12, which is provided with a locking screw 16 for interlocking the top plate 12 with the scale rod 15. The top plate 12 is also provided with an adjusting screw 17 having a star wheel to permit accurate adjustment of the angle of the top plate 12 relative to the base plate 10.

Figure 2:
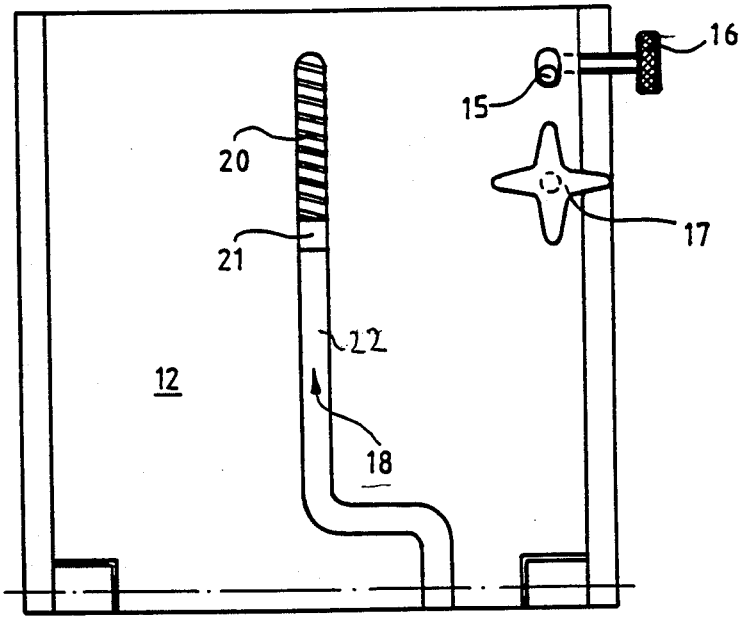
FIG. 2 is a top view of the support base.
Figure 3:
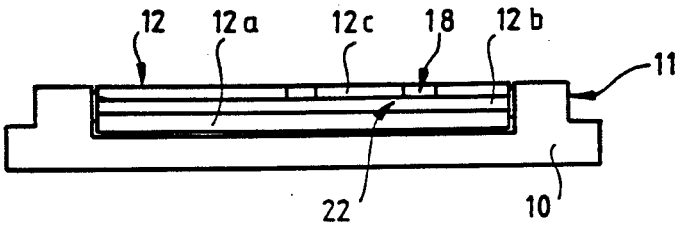
FIG. 3 is a front view of FIG. 2.

In the embodiment as shown in FIGS. 2 and 3 the top plate 12 consists of three layers 12a, 12b and 12c which cooperate to form a guide structure 18 for a receptacle 19 so as to be movably guided thereby. A spring 20 is disposed at one end of the guide structure 18 which also carries, associated with the spring 20, a pressure block 21 such that the receptacle may be urged toward the grinding disc 7 with a predetermined force as given by the spring 20. The spring 20 also permits immediate disengagement of the workpiece from the grinding disc if the workpiece should be come caught by the grinding disc. In this embodiment of the top plate 12 the receptacle 19 is mounted on a slide which is inserted into the guide channel 22 of the guide structure 18. Instead of the guide structure of the guide channel 22 there may be provided a slidably support plate 23 which is movably supported on the top plate 12 so that it is slidably in the direction as indicated by double arrow 24. A grasping column 25 is disposed on the support plate 23 and adapted to receive and firmly engage the receptacle 19. The receptacle 19 includes a top holder 28 adapted to receive the casting pin 27 which projects from the primary casting 26 to be ground or polished and firmly engage the pin 27. The top holder 28 is rotatably supported on the column 25 so as to permit grinding of said casting from all its sides.

A further embodiment is shown in FIG. 4 where the grasping column 25, the top holder 28 or the drill chuck are mounted on a pivot arm 29 which is pivotally supported on the top plate 12.

After adjustment of the top plate 12 to the appropriate angular position relative to the base plate 10 by means of the adjustment screw 17, the appropriate position being visible from the scale rod 15, and after locking the top plate 12 relative to the base plate 10 by way of the locking screw 16, the electric motor 3 is position-adjusted to the appropriate height and the primary crown casting 26 held in the top holder 28 is moved toward the grinding disc 7 where it is ground at the appropriate angle relative to its centerline, that is, relative to casting pin 27.

In the embodiment of FIGS. 5, 6 and 7, the electric motor 3 and the grinding disc 7 are surrounded by a housing 35 as to provide only an annular opening 38 between the housing 35 and the disc 7. The support column 2 is hollow and is in communication with the annular opening 38 and the support column 2 has a suction nozzle 34 mounted thereon for connection to a suction line in order to such away all the grinding dust generated at the grinding disc 7.

In the arrangement of FIG. 5 the top plate of the base 1 is inclined so as to define a desk plate 30 on which a support block 31 is slidably disposed which carries a drill chuck 33 on top of a grasping column 32. As shown, the casting 26 is mounted in the chuck 33 by way of the casting pin 27. The grasping column 32 is provided with a pivot joint 36 which permits tilting of the grasping column by 6 in each direction and, together therewith, of the drill chuck 33 and the casting 26 carried thereby as is indicated by arrows 37a, 37b. The pivot joint 36 is provided with a locking toggle 39 for locking the joint in the desired angular position. The support block 31 is provided with a leg which extends downwardly through a slot 40 formed in the desk plate 30 (FIG. 7) and is engaged below the desk plate 30 by a guide structure (not shown) which insures that the support block 31 and together therewith the drill chuck 33 and the casting 26 are rectilinearly movable toward the grinding disc 7. The leg is engaged by a spring which tends to force the support block 31 away from the grinding disc 7 in the direction of arrow 41 so that for movement of the support block 31 toward the grinding disc 7, that is, in the direction of arrow 42, a certain force must be applied which facilitates manipulation of the structure and the application of light grinding pressures to the casting 26.

What is claimed is:

1. An apparatus for the grinding or polishing of cylindrical or conical primary crown castings which have a pin extending from their top sides in axial alignment with the centerline of the castings (0° position) which pin is formed by the casting channel supplying the casting material during casting of the crown, said apparatus comprising a base, a support column mounted on said base, an electric motor mounted on said support column such that the shaft of said motor extends parallel to said base, said shaft carrying a grinding and polishing disc, an adjustable table mounted on said base so as to permit adjustment of the angle of said table relative to said base and a receptacle supported on said table so as to be movable toward and from said column, said receptacle being adapted to receive and engage the pin projecting from said casting for secure guided movement of said casting toward said disc for grinding or polishing the surface of said casting at a predetermined angle, said electric motor and said grinding disc being closely surrounded by a shroud so as to provide an air flow space between said motor and said shroud, and said support column being hollow and in communication with the air flow space formed by said shroud, said column further being provided with a suction nozzle for connection to a suction line for the removal of grinding or polishing dust from said grinding disc through said air flow space.

2. An apparatus according to claim 1, wherein said adjustable table consists of base and top plates pivotally joined by hinges, said base plate being slidably supported on said base so as to be movable toward and from said support column and said base plate also being lockable in certain desired positions, said receptacle being mounted on said top plate.

3. An apparatus according to claim 2, wherein said top plate includes a guide structure for said receptacle.

4. An apparatus according to claim 1, wherein said receptacle is a drill chuck supported by a pivot joint structure.

5. An apparatus according to claim 1, wherein said receptacle is provided with a grasping column to facilitate moving of said receptacle toward said column.

6. An apparatus according to claim 1, wherein a spring is so disposed in said base as to engage the receptacle support for applying thereto a force in a direction away from said support column.

7. An apparatus according to claim 1, wherein said electric motor is height-adjustably mounted on said support column.

8. An apparatus for the grinding or polishing of cylindrical or conical primary crown castings which have a pin extending from their top sides in axial alignment with the centerline of the castings (0° position) which pin is formed by the casting channel supplying the casting material during casting of the crown, said apparatus comprising a base, a support column mounted on said base, an electric motor mounted on said support column such that the shaft of said motor extends parallel to said base, said shaft carrying a grinding and polishing disc, a pivot structure mounted on said base so as to be movable toward and from said column, said pivot structure carrying a receptacle adapted to receive and engage the pin projecting from said casting for secure guided movement of said casting toward said disc for grinding or polishing the surface of said casting at a predetermined angle, said electric motor and said grinding disc being closely surrounded by a shroud so as to provide an air flow space between said motor and said shroud, and said support column being hollow and in communication with the air flow space formed by said shroud, said column further being provided with a suction nozzle for connection to a suction line for the removal of grinding or polishing dust from said grinding disc through said air flow space.

9. An apparatus according to claim 8, wherein said receptacle is a drill chuck supported by a pivot joint structure.

10. An apparatus according to claim 8, wherein said receptacle is provided with a grasping column to facilitate moving of said receptacle toward said column.

11. An apparatus according to claim 8, wherein a spring is so disposed in said base as to engage the receptacle support for applying thereto a force in a direction away from said support column.

12. An apparatus according to claim 8, wherein said electric motor is height-adjustably mounted on said support column.

* * * * *